US010322863B2

(12) United States Patent
Miyamoto

(10) Patent No.: US 10,322,863 B2
(45) Date of Patent: Jun. 18, 2019

(54) TIGHT FASTENING TYPE SIZE-FREE CONTAINER CARRYING BAG

(71) Applicant: GARUTSU CO., LTD., Fukui (JP)

(72) Inventor: Takehisa Miyamoto, Fukui (JP)

(73) Assignee: CB-BIZ LIMITED LIABILITY COMPANY, Fukui (JP)

( * ) Notice: Subject to any disclaimer, the term of this patent is extended or adjusted under 35 U.S.C. 154(b) by 78 days.

(21) Appl. No.: 15/304,876

(22) PCT Filed: Jun. 8, 2016

(86) PCT No.: PCT/JP2016/067142
§ 371 (c)(1),
(2) Date: Oct. 18, 2016

(87) PCT Pub. No.: WO2017/104150
PCT Pub. Date: Jun. 22, 2017

(65) Prior Publication Data

US 2018/0016076 A1 Jan. 18, 2018

(30) Foreign Application Priority Data

Dec. 16, 2015 (JP) ..... 2015-245508

(51) Int. Cl.
*B65D 77/04* (2006.01)
*B65D 77/26* (2006.01)
(Continued)

(52) U.S. Cl.
CPC ..... *B65D 77/0406* (2013.01); *B65D 33/00* (2013.01); *B65D 33/08* (2013.01); *B65D 77/26* (2013.01)

(58) Field of Classification Search
CPC ..... B65D 77/0406; B65D 33/08; B65D 77/26
(Continued)

(56) References Cited

U.S. PATENT DOCUMENTS 3,316,950 A * 5/1967 Fleischer ..... B65D 31/147 383/210
3,511,436 A * 5/1970 Kessler ..... B65D 33/22 383/210
(Continued)

FOREIGN PATENT DOCUMENTS

JP 60182345 U1 12/1985
JP 06008242 U 2/1994
(Continued)

OTHER PUBLICATIONS

Machine translation of the description of JP2013023274.*
(Continued)

*Primary Examiner* — Jes F Pascua
(74) *Attorney, Agent, or Firm* — Bacon & Thomas, PLLC

(57) ABSTRACT

Provided is a tight fastening type size-free container carrying bag which has a simple configuration, can be manufactured at a low cost, and can be reliably fit to various shapes of containers size freely to stably hold the containers. Employed is a technical means corresponding to a bag body in which a pair of sheet materials made of a thermoplastic resin material faces and overlaps each other, an opening is formed at a top portion, and a bottom surface is included at a bottom portion, wherein at least one container holding portion is formed in the bag body, wherein a holding zone in which a plurality of spot joining portions formed by joining inner surfaces of both the sheet materials of the bag body each other in dot shapes is provided is formed in the container holding portion.

3 Claims, 7 Drawing Sheets

(51) Int. Cl.
*B65D 33/08* (2006.01)
*B65D 33/00* (2006.01)

(58) Field of Classification Search
USPC ..... 383/38, 40, 210, 211
See application file for complete search history.

(56) References Cited

U.S. PATENT DOCUMENTS 3,749,237 A * 7/1973 Dorton ..... A61F 13/20 206/390
3,979,050 A * 9/1976 Cilia ..... B65D 33/002 383/35
4,234,086 A * 11/1980 Dorton ..... B65D 33/002 206/286
4,674,128 A * 6/1987 Ruff ..... B65D 85/78 229/87.5
5,184,724 A * 2/1993 Mayled ..... B65B 9/093 206/466
5,603,406 A * 2/1997 Weder ..... A01G 5/04 206/423
5,704,108 A 1/1998 Weder
6,322,044 B1 * 11/2001 Vangedal-Nielsen ..... F25C 1/243 249/110
7,712,962 B1 * 5/2010 Reuhs ..... B65D 31/04 383/105
D799,981 S * 10/2017 Miyamoto ..... D9/703

FOREIGN PATENT DOCUMENTS

JP H11 227791 A 8/1999
JP H11227791 A 8/1999
JP 2013 023274 A 3/2006
JP 2006143236 A * 6/2006
JP 2006225008 A * 8/2006
JP 2008080072 A 4/2008
JP 2006 225008 A 2/2013
JP 2016098039 A * 5/2016
WO 2017104150 A1 6/2017

OTHER PUBLICATIONS

Japanese Patent Gazette issued on May 18, 2016 for Japanese Paten No. 5920754 registered on Apr. 22, 2016.
CD-ROM of the specification and drawings annexed to the request of Japanese Utility Model Application No. 3887/1992 (Laid-open No. 8242/1994) Kabushiki Kaisha Ishiyama, Feb. 1, 1994 (Feb. 1, 1994).
European Search Report dated Jun. 26, 2018, issued in corresponding European application No. EP 16 78 1655.

* cited by examiner

TIGHT FASTENING TYPE SIZE-FREE CONTAINER CARRYING BAG

TECHNICAL FIELD

The present invention relates to an improvement in a container carrying tool, and more specifically, to a tight fastening type size-free container carrying bag which has a simple configuration, can be manufactured at a low cost, and can be reliably fit to various shapes of containers size freely to stably hold the containers.

BACKGROUND ART

When a beverage such as coffee and juice or food such as fish cake and soup is put in a temporary container (having a simple disposable type not sealed by a stopper) and taken out in a convenience store, a fast-food restaurant, or the like, it may be convenient if this temporary container can be stably carried without being directly held by a hand.

First, directly putting the temporary container in a bag is considered as such a carrying scheme. However, there is lack of stability, and there is a concern that the temporary container may tilt inside the bag, and contents such as the beverage or the soup may leak.

In addition, there is a scheme in which a mount having a hole of cardboard and the like is spread at the bottom of the bag, and the temporary container is erected in the hole in order to maintain a position of the temporary container. However, there have been problems that it costs to stock the mount, a setting operation requires an effort, and it takes time to provide goods.

Further, a bag that can carry a temporary container in a portable type is disclosed (for example, see Patent Document 1). However, only one temporary container can be carried per bag, and only a single size can be handled. Furthermore, since a main body of the temporary container is exposed to the outside, there is a concern that the temporary container may be stained, or an object around the temporary container may be stained when contents of a beverage, soup, and the like are leaked by mistake.

In addition, a bag is disclosed in which an opening provided in a holding piece at an opening of the bag is inserted into a container (bottle) (for example, see Patent Document 2). However, an operation of inserting the opening into the container each time goods are provided is extremely annoying. In particular, the operation is significantly difficult in the case of a tapered temporary container such as a beverage cup in which an opening diameter at the top portion is large.

In addition, a temporary container and a carrying bag are temporary and used up after being used from a store to a home or the like, and thus a simple configuration and a low cost are essential, which are required to be compatible with reliable holding performance.

CITATION LIST

Patent Document

Patent Document 1: JP 2008-80072 A
Patent Document 2: JP 60-182345 U

SUMMARY OF THE INVENTION

Problem to be Solved by the Invention

The invention has been conceived in view of the fact that a conventional container carrying tool has the above-mentioned problem, and an object of the invention is to provide a tight fastening type size-free container carrying bag which has a simple configuration, can be manufactured at a low cost, and can be reliably fit to various shapes of containers size freely to stably hold the containers.

Means for Solving Problem

Means adopted by the inventor to solve the above-mentioned technical problem are described below with reference to accompanying drawings.

That is, the invention completed a tight fastening type size-free container carrying bag by employing a technical means corresponding to a bag body 1 in which a pair of sheet materials 10, 10 made of a thermoplastic resin material faces and overlaps each other, an opening 11 is formed at a top portion, and a bottom surface 12 is included at a bottom portion, wherein at least one container holding portion is formed in the bag body 1, wherein a holding zone 2 in which a plurality of spot joining portions 21, 21, . . . formed by joining inner surfaces of both the sheet materials 10, 10 of the bag body 1 each other in dot shapes is provided is formed in the container holding portion, a main body of a container C is pressed against at least a portion of a spot joining portion 21 in the holding zone 2 and a spot joining portion 21 in a pressed part is allowed to be peeled off when the container C is inserted from the opening 11, and movement of the container C inside the bag body 1 is regulated to allow the container C to be stably supported and carried when a remaining endmost spot joining portion 21 adheres to an outer circumferential surface of the container C in an inserted state, and the outer circumferential surface of the container C is tightened between the sheet materials 10.

In addition, to solve the above-mentioned problem, in addition to the above means, the invention may employ a technical means as necessary in which a container insertion portion is formed at a center of the container holding portion of the bag body 1, and the holding zone 2 is substantially symmetrically provided on each of right and left sides of the container insertion portion.

Furthermore, to solve the above-mentioned problem, in addition to the above means, the invention may employ a technical means as necessary in which a stopper 3 obtained when the inner surfaces of both the sheet materials 10, 10 of the bag body 1 adhere to each other is formed on an outside of the holding zone 2.

Effect of the Invention

The invention is a bag body in which a pair of sheet materials made of a thermoplastic resin material faces and overlaps each other, an opening is formed at a top portion, and a bottom surface is included at a bottom portion. When at least one container holding portion is formed in the bag body, and a holding zone in which a plurality of spot joining portions formed by joining inner surfaces of both the sheet materials of the bag body each other in dot shapes is provided is formed in the container holding portion, a main body of a container is pressed against at least a portion of a spot joining portion in the holding zone and a spot joining portion in a pressed part is allowed to be peeled off when the container is inserted from the opening, and movement of the container inside the bag body is regulated to allow the container to be stably supported and carried when a remaining endmost spot joining portion adheres to an outer circumferential surface of the container in an inserted state, and the outer circumferential surface of the container is tightened between the sheet materials.

Therefore, a tight fastening type size-free container carrying bag of the invention has a simple configuration and may be manufactured at a low cost, and thus is significantly suitable for use for a temporary (used up, disposable) object from a store to a home or the like, such as carrying of a temporary container such as a beverage cup.

In addition, since only a necessary portion of a spot joining portion is peeled off according to a shape of a container to be carried, various shapes of containers may be reliably and size freely fit thereto and stably held.

Further, since a carrying bag of the invention is disposable, the carrying bag becomes a dedicated one by conforming to a size of a temporary container to be carried without the need to join a peeled spot joining portion again. Thus, a manufacturing accuracy of a bag body may be decreased.

In addition, since a sheet material adheres to an outer circumferential surface of a container supported by a carrying bag of the invention, even a relatively vertically long beverage container which becomes inevitability substantially upright may be significantly stably carried.

Furthermore, since a plurality of containers may be carried by increasing container holding portions as necessary, industrial usefulness is extremely large.

MODE(S) FOR CARRYING OUT THE INVENTION

Figure 1:
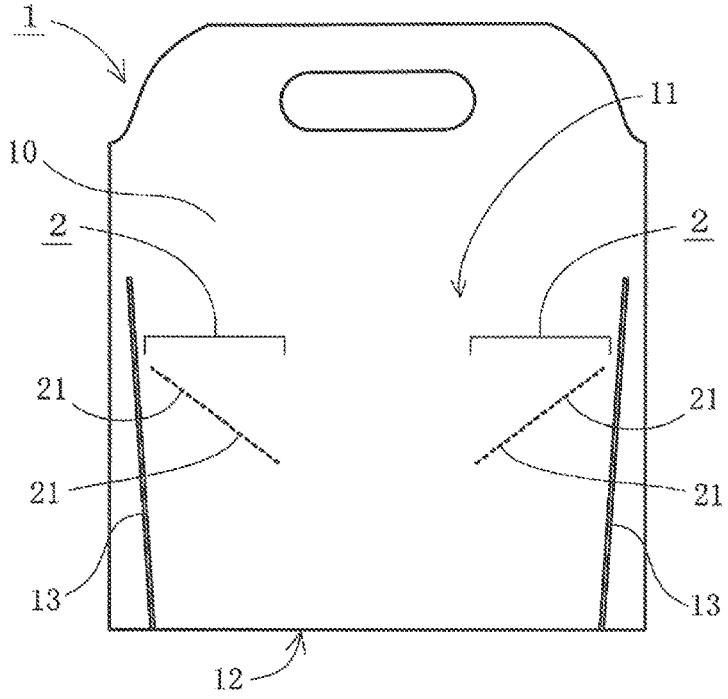
FIG. 1 is a front cross-sectional view illustrating a configuration of a container carrying bag of an embodiment of the invention.

An embodiment of the invention will be described based on FIG. 1 to FIG. 14. In the figures, reference numeral 1 indicates a bag body, and reference numeral 2 indicates a holding zone. This holding zone 2 is a region having a predetermined area and including a plurality of spot joining portions 21, 21, . . .

Then, when a tight fastening type size-free container carrying bag of the invention is configured, first, a pair of sheet materials 10 and 10 made of a thermoplastic resin material is superposed on each other by facing each other. In the present embodiment, a polyolefin resin such as polyethylene (PE), polypropylene (PP), or polyethylene terephthalate (PET), nylon may be employed as this resin material.

In addition, the bag body 1 has an opening 11 formed at a top portion, and a bottom surface 12 at a bottom. As a scheme of superposing the sheet materials 10 and 10, the bag body 1 may be folded back on the bottom surface 12 to superpose the sheet materials 10 and 10. In this instance, a gusset is preferably formed on the bottom surface 12 to form a bag bottom, and a bottom surface of a container is placed on the gusset to increase stability while ensuring a capacity of the bag body. In addition, a handle part for holding the bag body 1 in a hand may be provided around the opening 11.

At least one container holding portion is formed in the bag body 1. The container holding portion refers to a unit part that holds one container. In addition, the holding zone 2 in which the spot joining portions 21, 21, . . . formed by joining inner surfaces of the both sheet materials 10 and 10 of the bag body 1 to each other in dot shapes is formed in the container holding portion. A dot shape of the spot joining portion 21 is preferably included in a region of about a maximum of 1 $cm^2$, and is more preferably included in a region of about 2 to 3 $mm^2$.

While this holding zone 2 is the region having the predetermined area and includes the plurality of spot joining portions 21, 21, . . . , a shape and an arrangement of the spot joining portion 21 have various modes as described below.

In addition, as a method of molding the spot joining portion 21, a die of a shape of the spot joining portion 21 in an arrangement designed in advance is molded and heat-pressed to a required position on a surface of the sheet material 10. In this instance, when a heating temperature or a pressure welding time of the die is appropriately changed according to a property of matter such as a melting point of a material of the sheet material 10, peel strength may be adjusted. When the peel strength is excessively large, peeling fails at the time of pressing a container C, or the sheet material 10 peels off to cause a hole. Meanwhile, when the peel strength is excessively small, there is a concern that the spot joining portion 21 corresponding to an unintended position may peel off, and thus the container C may move inside the bag body 1.

<Arrangement Example 1>

In this arrangement example, a container insertion portion is formed at a center of the container holding portion of the bag body 1, and the holding zone 2 is substantially symmetrically provided on each of right and left sides of this container insertion portion (see FIG. 1). The spot joining portions 21, 21, . . . in the holding zone 2 are arranged to be linearly provided from an outer and upper side toward an inner and lower side, and the spot joining portion 21 and a gap having substantially the same size as a size of the spot joining portion 21 are alternately provided.

Figure 2:
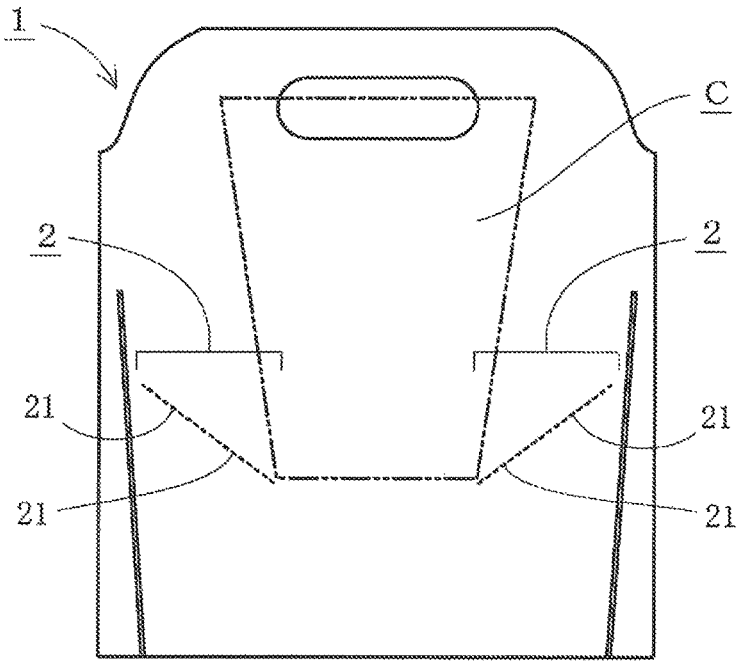
FIG. 2 is a front cross-sectional view illustrating a usage state of the container carrying bag of the embodiment of the invention.
Figure 3:
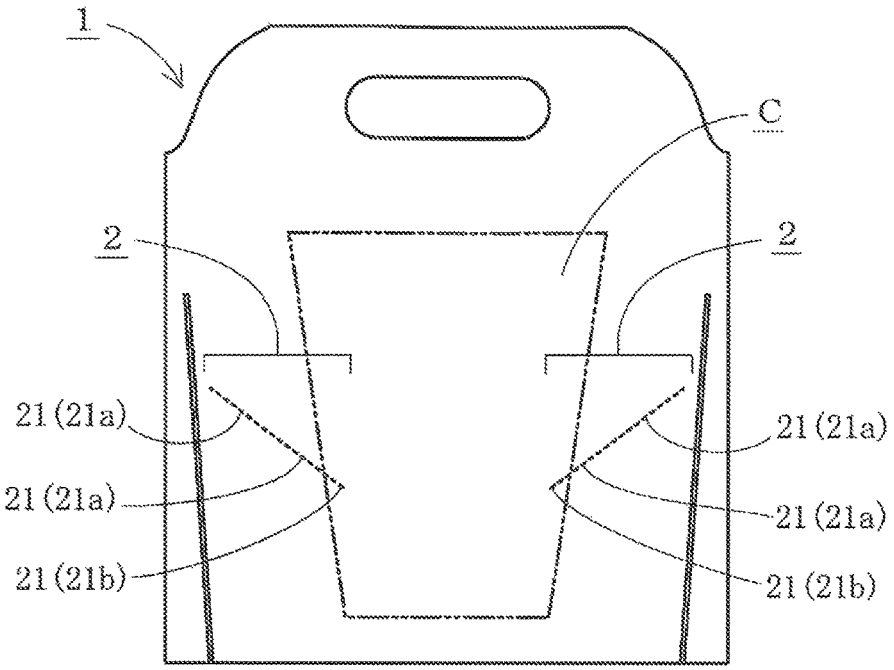
FIG. 3 is a front cross-sectional view illustrating a usage state of the container carrying bag of the embodiment of the invention.

In addition, when the container C (two-dot chain line in the figure) is inserted from the opening 11 as illustrated in FIG. 2, a main body of the container C is pressed against at least a portion of the spot joining portion 21 in the holding zone 2 as illustrated in FIG. 3, and thus the spot joining portion 21 corresponding to this pressed part may be peeled off.

Figure 4:
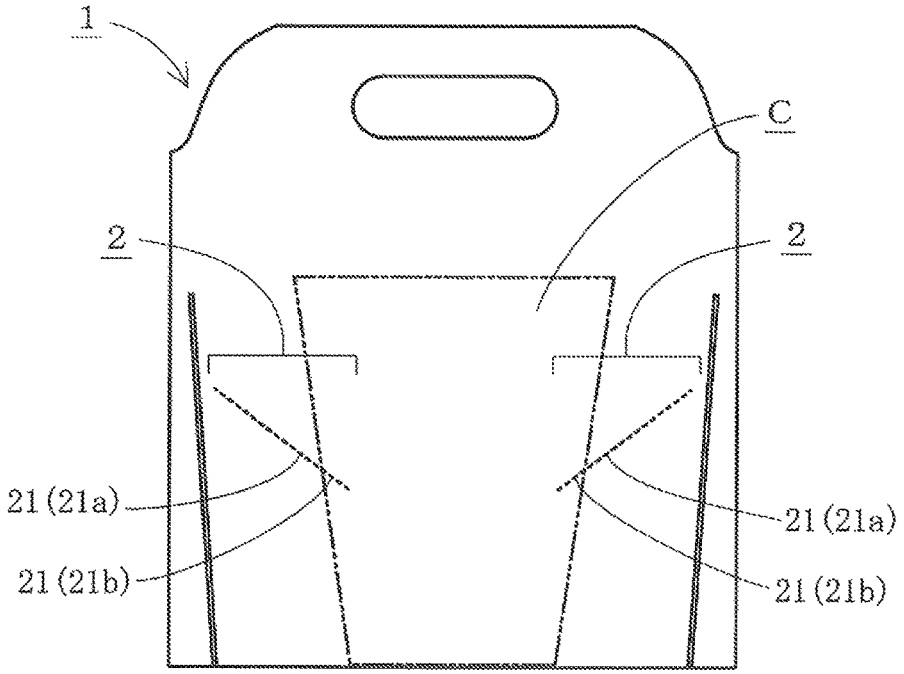
FIG. 4 is a front cross-sectional view illustrating a usage state of the container carrying bag of the embodiment of the invention.
Figure 5:
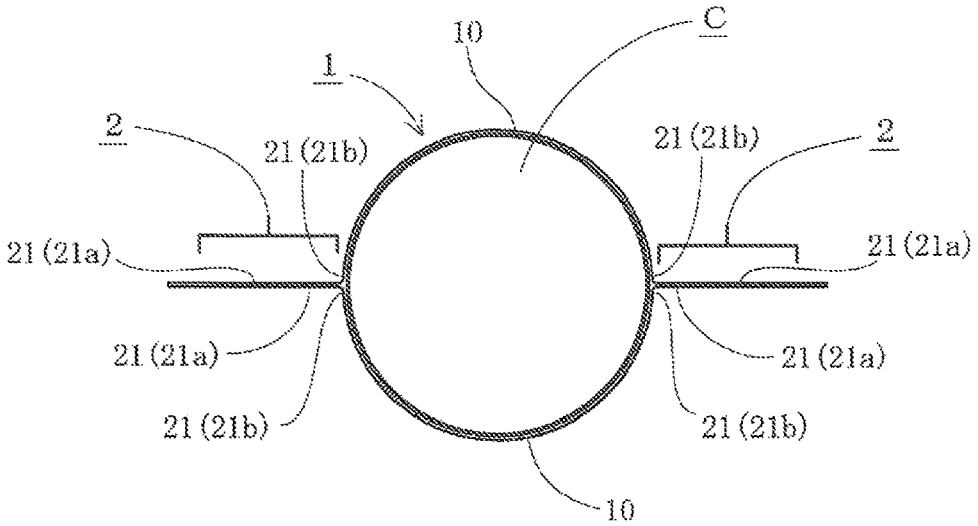
FIG. 5 is a top cross-sectional view illustrating a container storing state of the container carrying bag of the embodiment of the invention.

Thereafter, as illustrated in FIG. 4, until the container C reaches the bottom surface 12 of the bag body 1, the spot joining portion 21 at a corresponding position is peeled off.

In this way, spot joining portions 21 pressed at the time of insertion are peeled off one by one. Finally, a remaining endmost spot joining portion 21 adheres to an outer circumferential surface of the container C in an inserted state, and the outer circumferential surface of the container C may be tightened by being wound around the sheet materials 10 and 10 (see FIG. 5).

In this way, movement of the container C inside the bag body 1 may be regulated, and the container C may be stably supported and carried.

In the present embodiment, the sheet material 10 of the bag body 1 may be configured by integrally stacking different thermoplastic resin materials, and only the inner surface of the sheet material 10 may be allowed to be peeled off. A known laminating method or adhesion using an adhesive may be adopted as a stacking scheme. In this way, penetration of the sheet material 10 may be prevented at the time of peeling, and a decrease in strength of the bag due to penetration (hole), a leakage of contents, and the like may be prevented.

In this instance, as a more specific combination, the sheet material 10 of the bag body 1 may be configured by integrally stacking thermoplastic resin materials having different melting points (for example, high density polyethylene (HDPE) and low density polyethylene (LDPE)), and a low-melting resin material (low density polyethylene) may be arranged at a predetermined position on the inner surface of the bag body 1, thereby allowing only a low-melting resin material portion of the sheet material 10 to be peeled off.

In addition, when such a stacked structure of the sheet material 10 is employed, only the low-melting resin material may be melted by performing processing (heat pressing and the like) at a temperature between a melting point of a high-melting resin material and a melting point of the low-melting resin material in a manufacturing process. Thus, the spot joining portion 21 may be easily and reliably molded without damaging the sheet material 10.

<Arrangement Example 2>

Figure 6:
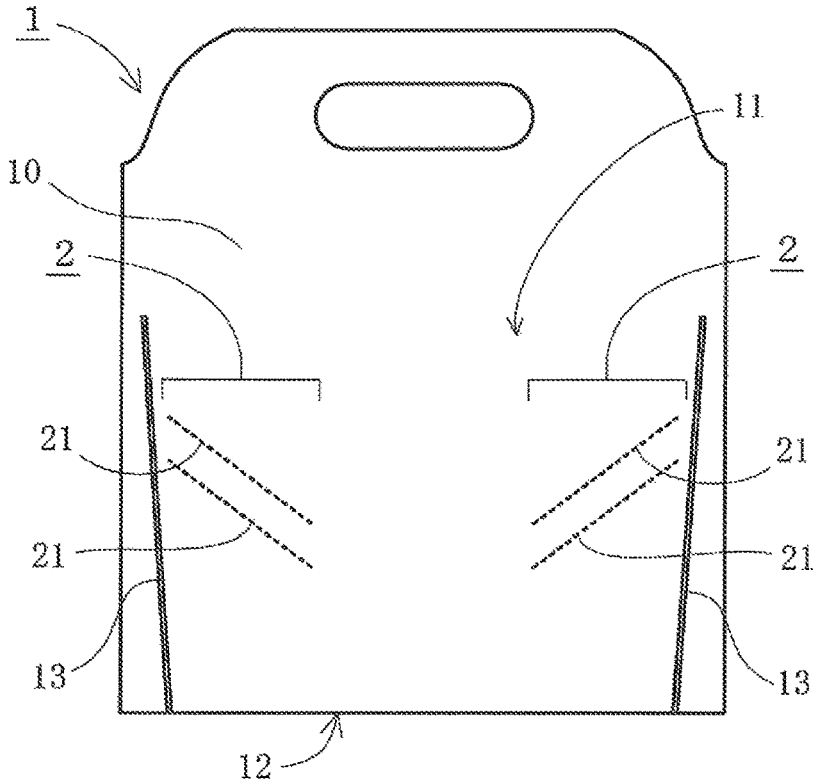
FIG. 6 is a front cross-sectional view illustrating a configuration of the container carrying bag of the embodiment of the invention.

According to an arrangement example illustrated in FIG. 6, two straight rows of <Arrangement example 1>, in which the spot joining portions 21, 21, . . . in the holding zone 2 are arranged to be linearly provided from an outer and upper side toward an inner and lower side, and the spot joining portion 21 and a gap having substantially the same size as a size of the spot joining portion 21 are alternately provided, are provided in parallel on each of right and left sides, thereby configuring the holding zone 2. In this way, support strength of the container may be improved.

<Arrangement Example 3>

Figure 7:
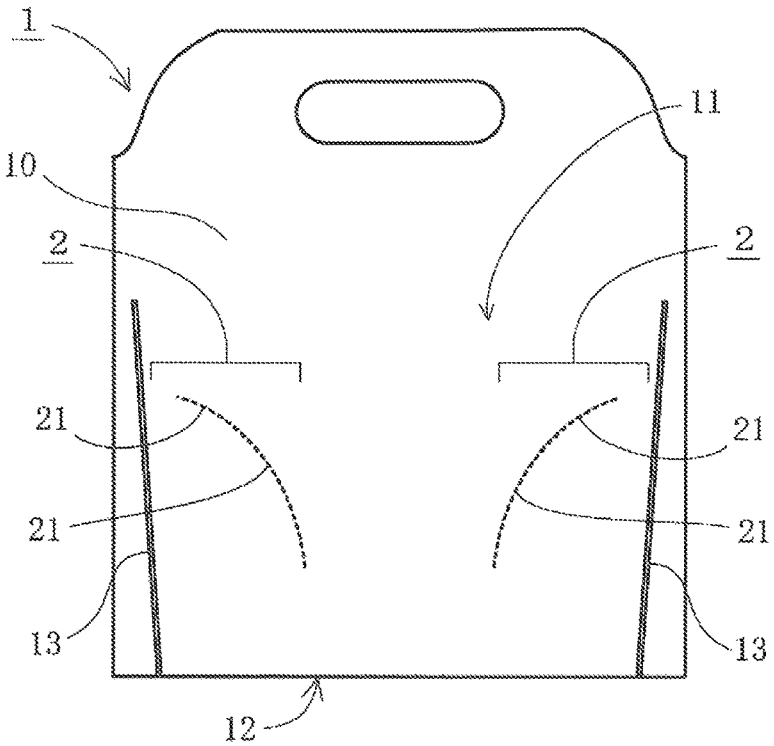
FIG. 7 is a front cross-sectional view illustrating a configuration of a modified example of the container carrying bag of the embodiment of the invention.
Figure 8:
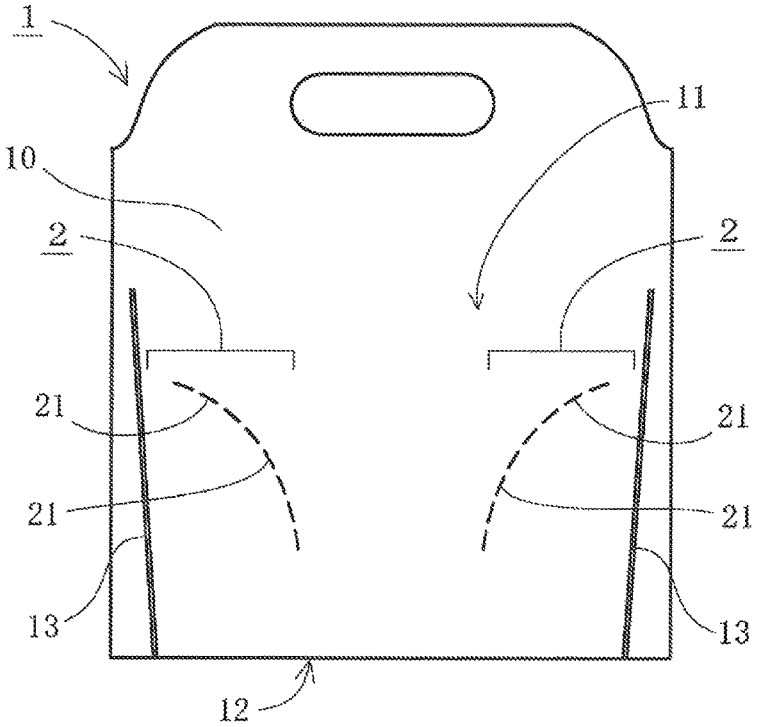
FIG. 8 is a front cross-sectional view illustrating a configuration of a modified example of the container carrying bag of the embodiment of the invention.

According to an arrangement example illustrated in FIG. 7 and FIG. 8, the spot joining portions 21, 21, . . . in the holding zone 2 are arranged to be curvedly provided from an outer and upper side toward an inner and lower side, the spot joining portion 21 and a gap are alternately provided, and a size (length) of the spot joining portion 21 may be adjusted according to support strength of the container C.

<Arrangement Example 4>

Figure 9:
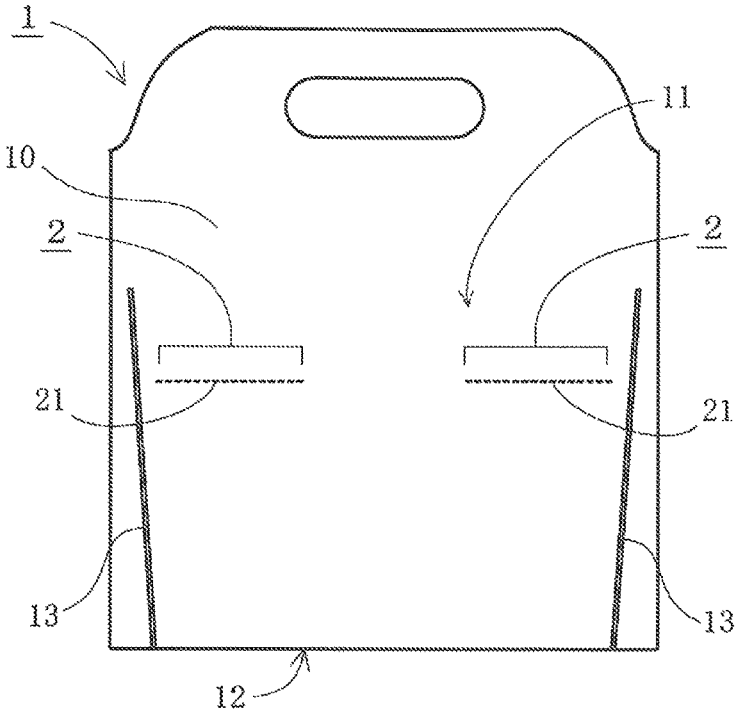
FIG. 9 is a front cross-sectional view illustrating a configuration of a modified example of the container carrying bag of the embodiment of the invention.

According to an arrangement example illustrated in FIG. 9, the spot joining portions 21, 21, . . . in the holding zone 2 are arranged to be linearly provided from an outer side toward an inner side immediately beside the outer side, and the spot joining portion 21 and a gap having substantially the same size as a size of the spot joining portion 21 are alternately provided. Even though an interval between the spot joining portions 21, 21, . . . becomes narrower downward in the above arrangement example, the same effects may be obtained even when the spot joining portions 21, 21, . . . are provided in a direction perpendicular to a container insertion direction as in the present arrangement example.

<Arrangement Example 5>

Figure 10:
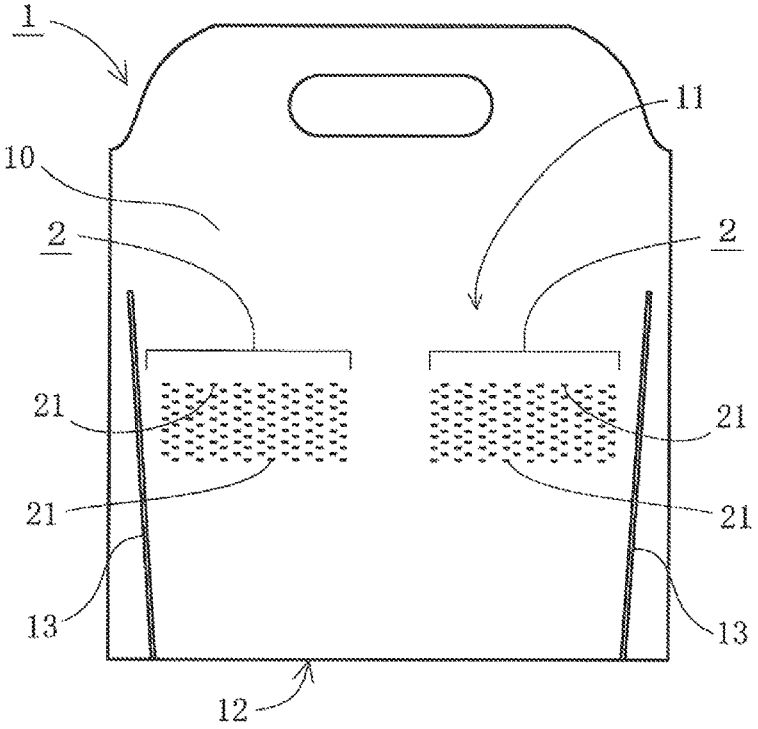
FIG. 10 is a front cross-sectional view illustrating a configuration of a modified example of the container carrying bag of the embodiment of the invention.

According to an arrangement example illustrated in FIG. 10, referring to arrangement of the spot joining portions 21, 21, . . . in the holding zone 2, a plurality of spot joining portions 21, 21, . . . is provided at intervals within a region having a predetermined area excluding the container insertion portion on the inside. In this instance, the spot joining portion 21 has an arbitrary size and shape.

<Arrangement Example 6>

Figure 11:
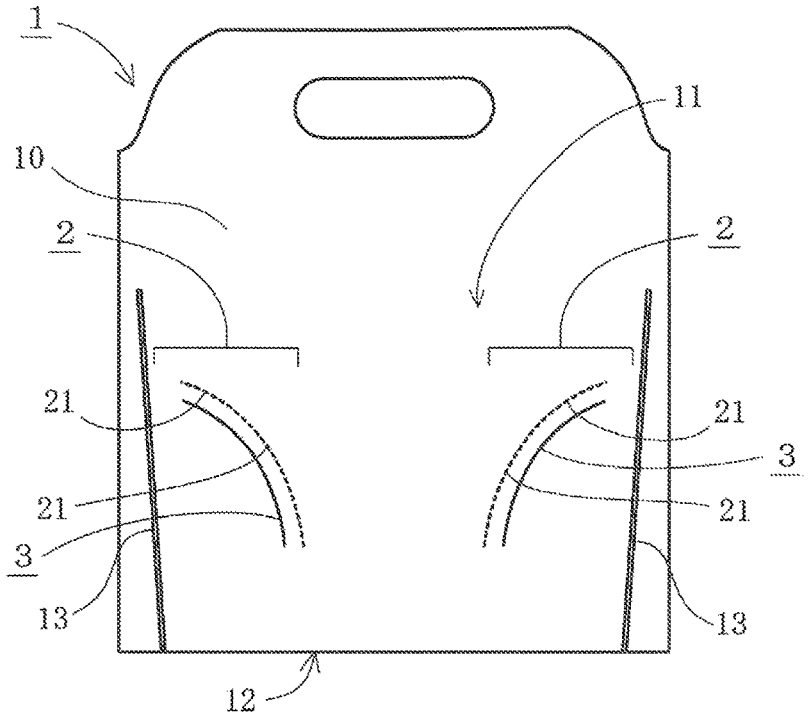
FIG. 11 is a front cross-sectional view illustrating a configuration of a modified example of the container carrying bag of the embodiment of the invention.

According to an arrangement example illustrated in FIG. 11, in addition to the spot joining portions 21, 21, . . . of <Arrangement example 1>, a stopper 3 obtained when the inner surfaces of the both sheet materials 10 and 10 of the bag body 1 adhere to each other is formed on an outside of the holding zone 2. In this way, even when all the spot joining portions 21, 21, . . . are erroneously peeled off, great damage in which the container C falls inside the bag body 1 may be prevented. Arrangement of the spot joining portions 21, 21, . . . at the time of providing the stopper 3 is not restricted to the illustrated arrangement.

<Arrangement Example 7>

Figure 12:
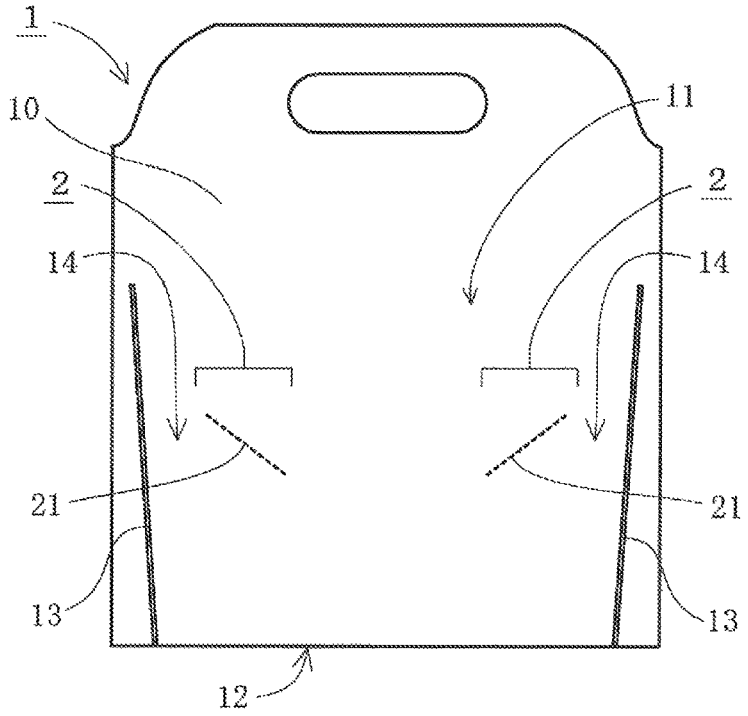
FIG. 12 is a front cross-sectional view illustrating a configuration of a modified example of the container carrying bag of the embodiment of the invention.

According to an arrangement example illustrated in FIG. 12, referring to arrangement of the spot joining portions 21, 21, . . . in the holding zone 2, a certain interval may be provided between the spot joining portion 21 on the outermost side and an adhesion portion 13 on a side of the bag body 1, and a pocket 14 may be formed therein. An appendage of a beverage or food accommodated in the container such as sugar, milk, a muddler may be inserted into the pocket 14 and held.

<Arrangement Example 8>

Figure 13:
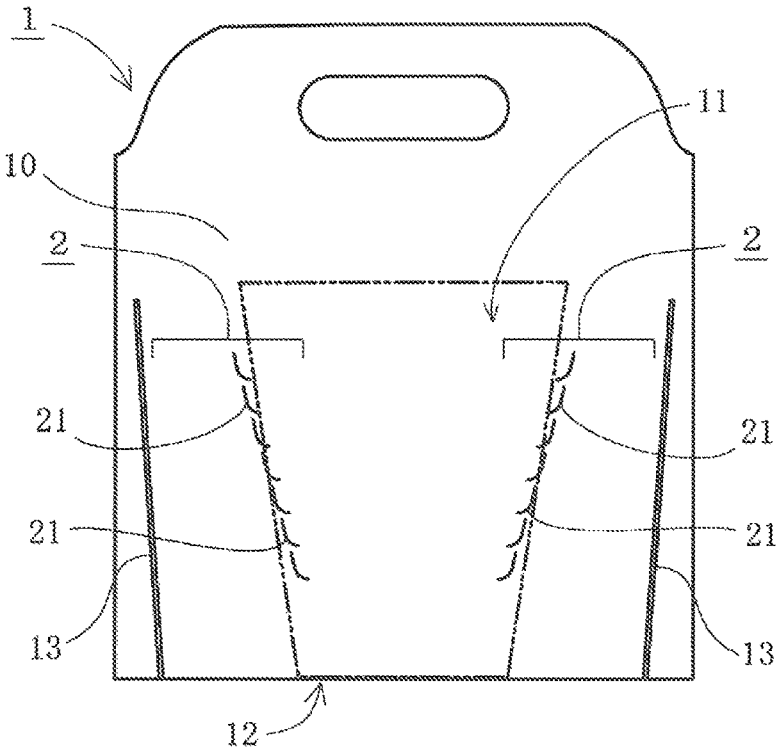
FIG. 13 is a front cross-sectional view illustrating a configuration of a modified example of the container carrying bag of the embodiment of the invention.

According to an arrangement example illustrated in FIG. 13, each spot joining portion 21 in the holding zone 2 is formed in a curved shape having a short side and a long side. In this way, the short side may be pressed at the time of insertion of the container C to peel off a portion or a whole of the spot joining portion 21, and an outer surface of the container C may adhere to the long side and be supported.

Even though the invention is roughly configured as described above, the invention is not restricted to the illustrated embodiment, and may be variously changed within the scope of claims. For example, the size, the shape, and the number of spot joining portions 21 in the holding zone 2 may be appropriately changed.

Figure 14:
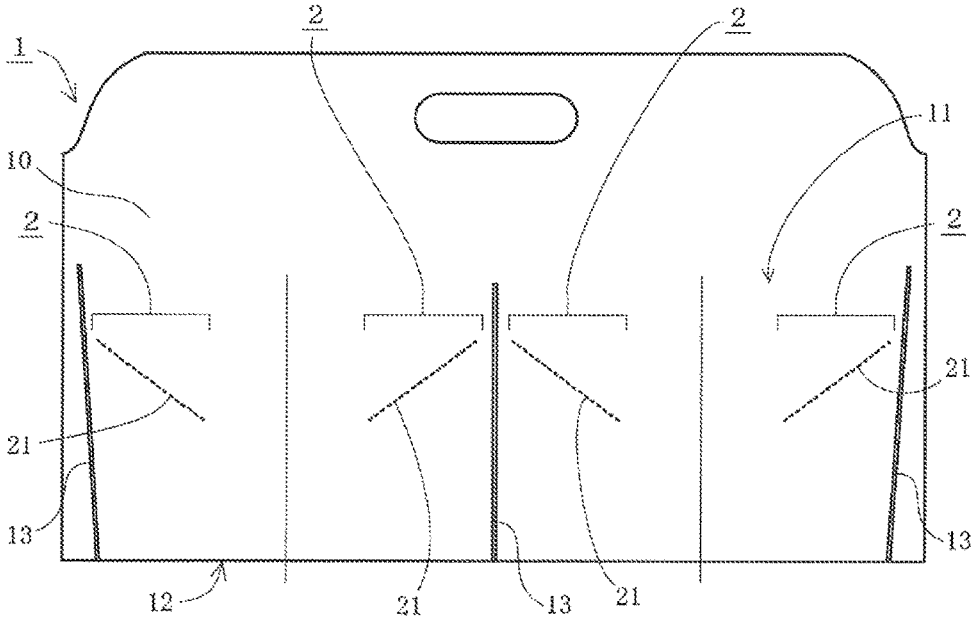
FIG. 14 is a front cross-sectional view illustrating a configuration of a modified example of the container carrying bag of the embodiment of the invention.

In addition, the number of container holding portions is not restricted to one. Two container holding portions may be formed as illustrated in FIG. 14, or three or more container holding portions may be formed in the bag body 1, which belongs to the technical scope of the invention.

EXPLANATIONS OF LETTERS OR NUMERALS

1: bag body

10: sheet material

11: opening
12: bottom surface
13: adhesion portion
14: pocket
2: holding zone
21: spot joining portion
21*a*: peeled spot joining portion
21*b*: remaining spot joining portion
3: stopper
C: container

The invention claimed is:

1. A tight fastening type size-free container carrying bag comprising:

a bag body in which a pair of sheet materials made of a thermoplastic resin material faces and overlaps each other, an opening is formed at a top portion, and a bottom surface is included at a bottom portion, a pair of linear adhesions formed between the pair of sheet materials, the linear adhesions extending in a direction between the top portion and the bottom portion to define a container holding portion therebetween, a holding zone defined within the container holding portion and configured to receive a container through said opening, wherein a plurality of spot joining portions are formed in said holding zone by joining inner surfaces of both the sheet materials of the bag body to each other in dot shapes is formed in the holding zone, and wherein the plurality of spot joining portions are arranged in a line extending from an outer and upper portion of the container holding portion toward an inner portion of the container holding portion, wherein when a main body of the container received in said holding zone is pressed against at least a portion of a spot joining portion, a spot joining portion in a pressed part is allowed to be peeled off, and wherein movement of the received container inside the bag body is regulated to allow the container to be stably supported and carried when a remaining endmost spot joining portion adheres to an outer circumferential surface of the received container, and the outer circumferential surface of the container is tightened between the sheet materials.

2. The tight fastening type size-free container carrying bag according to claim 1, wherein a container insertion portion is formed at a center of the container holding portion of the bag body, and the holding zone is substantially symmetrically provided on each of right and left sides of the container insertion portion.

3. The tight fastening type size-free container carrying bag according to claim 1, wherein a stopper obtained when the inner surfaces of both the sheet materials of the bag body adhere to each other is formed on an outside of the holding zone.

* * * * *